United States Patent [19]

Volke et al.

[11] Patent Number: 4,497,588

[45] Date of Patent: Feb. 5, 1985

[54] PRINTING OR TYPING APPARATUS WITH A ROTATING PLATEN AS WELL AS GUIDE DEVICES FOR THE PAPER

[75] Inventors: Hans-Werner Volke, Salzkotten; Jürgen Hilkenmeier, Paderborn; Hermann Kohlhage, Paderborn; Udo Tewes, Paderborn, all of Fed. Rep. of Germany

[73] Assignee: Nixdorf Computer AG, Fed. Rep. of Germany

[21] Appl. No.: 430,436

[22] Filed: Sep. 30, 1982

[30] Foreign Application Priority Data

Apr. 20, 1982 [DE] Fed. Rep. of Germany ..... 3214634

[51] Int. Cl.[3] ..... B41J 13/10

[52] U.S. Cl. ..... 400/645.1; 400/642

[58] Field of Search ..... 400/645.1, 643, 642, 400/645, 645.3, 645.5, 335, 161.1, 162.1, 154, 320; 242/147 R

[56] References Cited

U.S. PATENT DOCUMENTS

| | | | |
|---|---|---|---|
| 3,035,680 | 5/1962 | Fondiller | 400/645.5 |
| 3,095,079 | 6/1963 | Morelli et al. | 400/642 |
| 3,224,547 | 12/1965 | Betzler | 400/642 |
| 4,403,877 | 9/1983 | Jones et al. | 400/335 |
| 4,437,777 | 3/1984 | Hori | 400/154.2 |

FOREIGN PATENT DOCUMENTS

| | | | |
|---|---|---|---|
| 386091 | 1/1908 | France | 400/645 |
| 7443631 | 9/1976 | France | 400/642 |
| 2378191 | 9/1978 | France | 74/37 |

*Primary Examiner*—Edgar S. Burr
*Assistant Examiner*—M. J. Hirabayashi
*Attorney, Agent, or Firm*—Krass & Young

[57] ABSTRACT

Printing apparatus with a roller platen and a plastic strip for holding paper against the roller platen even if insufficient paper is fed through to reach the usual guide rollers. The plastic strip is arranged in a closed loop and is connected to the print element to move with it in the line direction. The strip has a perforation for the penetration of printing type or the like.

3 Claims, 7 Drawing Figures

PRINTING OR TYPING APPARATUS WITH A ROTATING PLATEN AS WELL AS GUIDE DEVICES FOR THE PAPER

DESCRIPTION

Introduction

The invention relates to a printer or recorder for printing an endless paper sheet or single sheet, including a rotatable platen, a print element arrangement movable in the line direction relative to the platen, as well as a plurality of guide devices or the like distributed over the periphery of the platen especially for guiding the front edge or rear edge of the paper fed around the platen.

BACKGROUND OF THE INVENTION

In general feed rolls are provided in the region of the platen, which feed the paper to the platen, and in the region where the paper is delivered from the platen, which rolls in cooperation with the rotatable platen conveying the paper. Between these and distributed over the periphery of the platen are arranged various guide devices fixed in relation to the platen, for example guide plates or the like, which have the task of guiding the front edge or the rear edge of the respective paper grasped by only one feed roll arrangement. A common difficulty is guiding the paper in the print region of the platen or applying the platen against the paper. A conventional guide device cannot be provided, since this would cover the print region of the platen and thereby make any printing impossible.

A consequence of this poor guiding in the print region is that when a new sheet of paper is grasped, it is occasionally lifted off of the platen in the print region and hooks onto parts of the printer, especially the print element arrangement. Also, even when the paper follows the platen, it does not lie against the platen tightly enough when it is not being grasped by both feed roll arrangements and stretched around the platen. Hence in the conventional printing or recording apparatus it is necessary to leave a fairly broad edge unprinted on both the top and the ends of the sheet, since paper lying only loosely against the platen would give an untidy, imprecise printed image.

BRIEF SUMMARY OF THE INVENTION

It is the task of the present invention to improve a printing or recording apparatus of the type mentioned at the start in such a way that in the print region of the platen an exact guiding and the proper positioning of the edge against the platen is ensured, so that any hanging of the paper in the print region is avoided and the paper is printed tidily and precisely without any loss at the borders.

This problem is solved according to the invention by a belt arranged in the print region of the platen, parallel to the latter and approximately tangential to the platen surface and separated slightly from it, fixed relative to the print element arrangement, which belt in the region of the print element arrangement shows a perforation for the penetration of the printing type or the like moved against the platen and which with its one edge overlaps guide devices arranged before the print region in the passage direction of the paper and with its other edge overlaps those arranged behind the print region.

By means of this belt the paper is fed around the platen tightly and evenly in the print region, i.e., there is no longer any gap between the guide devices arranged before the print unit and those arranged behind it. The belt is interrupted only in the region of the print element arrangement for the penetration of printing type. For this the belt need not be completely interrupted, but rather it is sufficient to punch out a hole in the belt.

The arrangement according to the invention can be used even with a printer that has a platen fixed in the axial direction and a print element which is arranged to be movable along the platen. Here, according to the invention, the belt is joined with the print element arrangement, and therefore moves with this along the platen. Where the belt ends in the region of the platen, the ends of the paper are held stretched respectively over delivery and feed units arranged in the apparatus housing. These delivery and feed units may, for example, be driven rolls or those provided with spring winding devices. However in a preferred development of the invention, for a print element arrangement movable in the line direction, the belt is constructed as an endless belt which is returned by way of deflection arrangements. These deflection arrangements are provided in the apparatus housing behind the print element arrangement on the side turned away from the platen.

In order to be able to observe the printing operation, the belt according to the invention is fabricated from a transparent material. If the belt itself is not elastic, it is held stretched by an elastic insert. The joining of the belt with the print element arrangement which is movable in the line direction is done by means of a shackle or the like arranged on one edge of the belt, said shackle being fastened to the print element arrangement. This fastening ensures that the perforation always remains exactly in the region of the print element.

In a special development of the invention, it is provided that the belt by one end engages somewhat in the manner of a scale over a guide plate or the like. This is arranged before the printing region in the passage direction of the paper more or less tangential to the platen surface. The belt by its other end engages under a roll carrier arranged behind the printing region and carries a plurality of feed rolls or the belt lies against the platen lightly. The belt is prepared from a material which does not smear the fresh printing ink. According to the invention there is also the possibility that the belt can be arranged separated from the paper to be printed by about the thickness of that said paper.

Further advantages and features of the invention can be seen in the description and the drawings. A number of embodiment examples of the invention are represented in the drawings and described in detail in the following.

DETAILED DESCRIPTION OF THE SPECIFIC EMBODIMENTS

Figure 1:
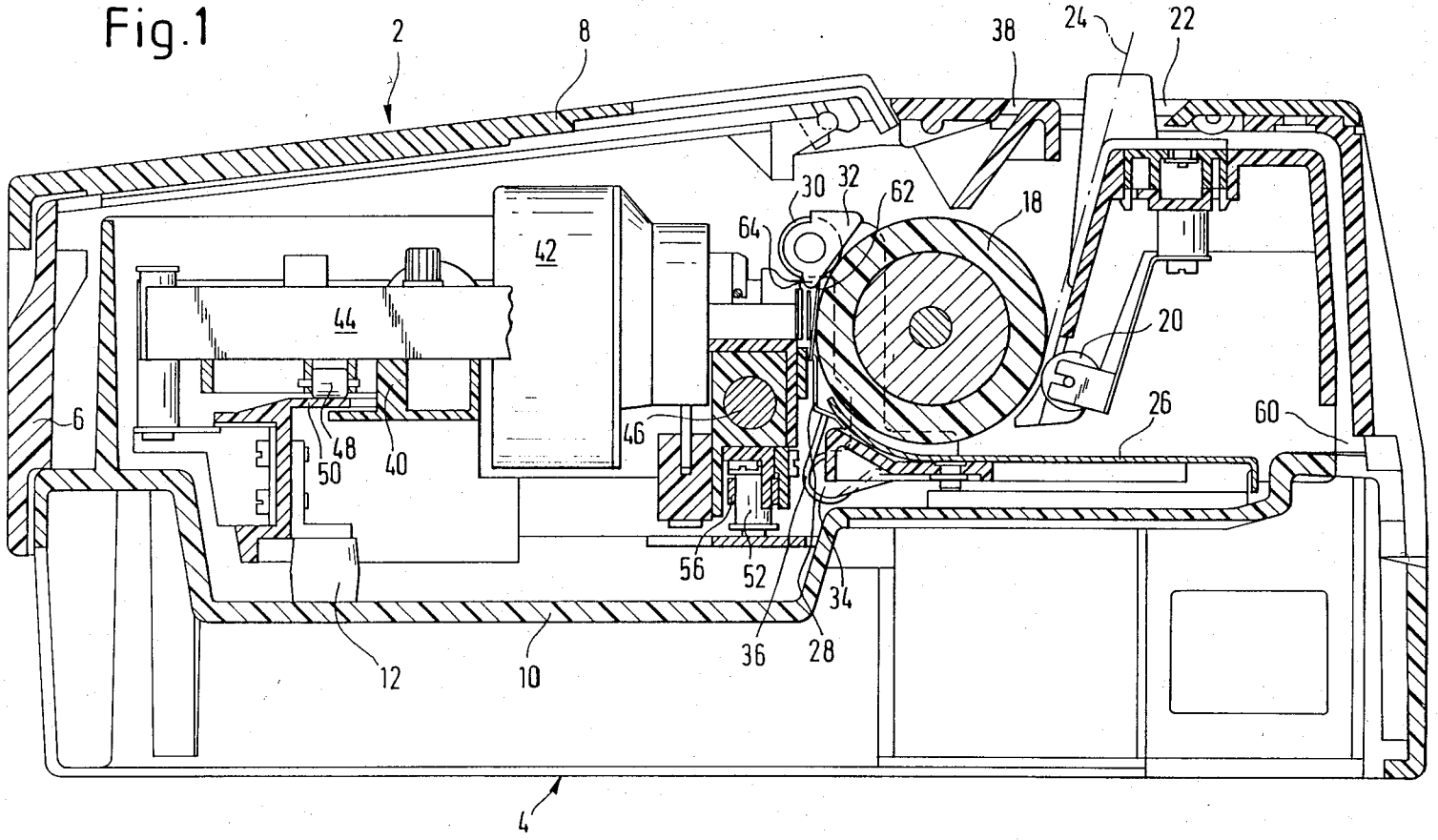
FIG. 1 shows a longitudinal section through a printer.

The printer apparatus shown in FIG. 1 is accommodated in a multipart housing 2. This consists of a bottom pan 4, a top pan 6 placed on bottom pan 4 and a covering cap 8. The whole of the control and program electronics including the power part is accommodated in the bottom pan 4, for example by means of a plug-in unit. The bottom pan 4 is closed off above by an intermediate bottom 10 and thus separates the electrical part from the printing mechanism proper arranged in the upper pan 6. The covering cap 8 closes off the top pan in a manner secure from dirt and provides sound-damping. In addition special covers can be provided for the feeding and delivery openings for the paper.

The top pan 6 containing the printing mechanism is fastened by way of vibration-damping feed 12 onto the bottom pan 4. The printing mechanism includes a platen 18 mounted to be rotatable and driven by a driving motor 14 by way of gearing means 16, see also FIG. 2. Feed rolls 20 cooperate with the platen 18, which rolls grasp a sheet of paper 24 fed through the feeding opening 22 in the covering cap and—with a rotation of the platen 18—convey it further. The sheet of paper is guided around the platen 18 by a guide plate 26. Adjacent to the guide plate 26 there is another guide plate 28 arranged more or less tangential to and separated slightly from the platen 18. Behind the printing region of the platen 18 in turn are provided feed rolls which are arranged on a common roll carrier 32. The roll carrier 32 is pivoted on a shaft 34 and is loaded by springs 36 in such a way that the feed rolls 30 are pressed against the platen 18. The feed rolls 30 take over the paper after it has passed through the print region and convey it to delivery openings 38. The roll carrier 32 can be swiveled away from the platen, thereby making the feed rolls 30 inactive.

In the upper pan 6 a carrier 40 is mounted in a movable manner in the line direction, which serves for receiving a print element 42 as well as an ink-ribbon magazine 44. In the platen region the carrier 40 is mounted in a movable manner on a supporting shaft 46 arranged parallel to the platen 18. At the end farthest from the platen 18 the carrier 40 is supported by way of a guide roll 48 on a guide track 50 on the top pan 6. Because the supporting shaft 46 is arranged well below and in front of the print region, the reaction forces of the printing operation as well as the weight of the print element 42 and of the ink-ribbon magazine 44 act on the supporting shaft 46 only to rotate it to the left in FIG. 1, so that the guide roll 48 is sufficient for supporting the carrier 40; lifting forces do not occur in this region.

In order to reliably prevent any tilting of the carrier, the movement drive of the carrier 40 is arranged directly under the supporting shaft 46. It consists of a timing belt 56 passed around two deflecting rolls 52, 54, one side of said belt being connected with the carrier 40. The deflection roll 54 is located directly on the shaft of the driving motor 58.

Figure 2:
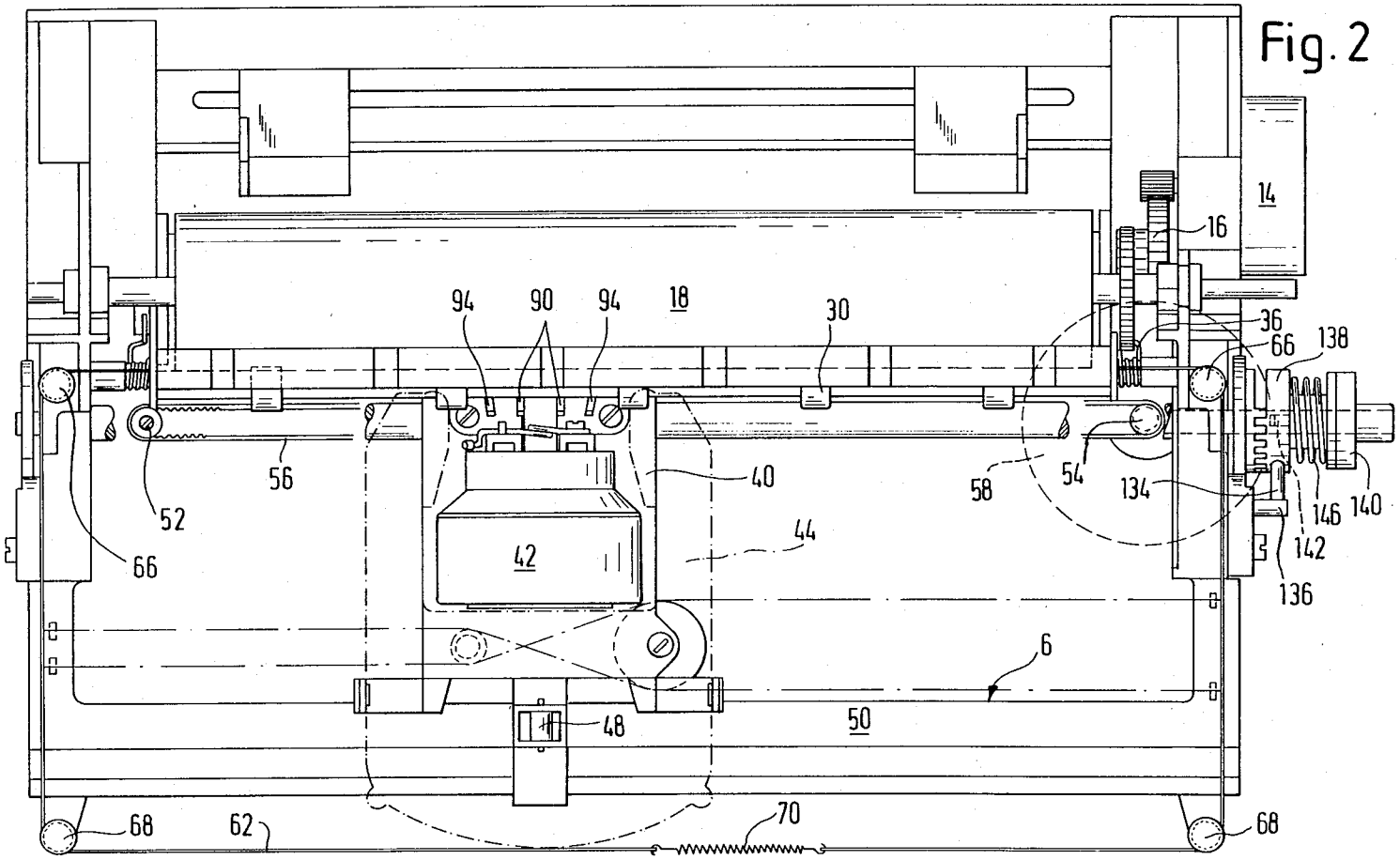
FIG. 2 shows a top plan view of a printer according to FIG. 1.

Next to the feed opening 22, which is predominantly for single sheets or paper running off a roll, another feed opening 60 serving to feed margin-perforated endless paper is provided on the back side of the housing 2. Since this paper is conveyed further by special means engaging in the margin perforation, it goes around the feed rolls 20 while the feed rolls 30 are lifted off. Both types of paper are fed to the print region by means of the guide plates 26 and 28. In order to ensure a reliable positioning of the paper in the print region on the platen 18 and in order to exclude any hooking of the paper on parts of the apparatus or of the print element with certainty, a belt 62 is provided parallel to the platen 18 and approximately tangential to and spaced apart slightly from this. This engages with its lower edge over the guide plate 28 on the one hand, and on the other hand engages with its top edge under a lug 64 arranged on the roll carrier 32. The belt 62 is situated either spaced apart by the thickness of the paper from the surface of the platen or lying directly against it. In this manner the paper in the print region always lies firmly against the surface of the platen 18 in the print region, even when it has not yet been grasped by the feed rolls 30 or the separate conveying unit provided for the endless paper. This ensures that the paper is printed exactly and neatly without loss at the top and bottom or side edges. As FIG. 3 in particular shows, the belt 62 is connected with the print element arrangement, especially the carrier 40, so that it is carried along by the latter in the line direction. As FIG. 2 shows, the belt 62 is designed as an endless belt and is guided over deflecting rollers 66 arranged in the region of the platen ends as well as deflecting rollers 68 arranged behind the print element arrangement. In order to keep the belt 62 stretched, a spring 70 holding together the two belt ends is provided. Directly in front of the print element 42 constructed as a matrix printer head the belt 62 shows a perforation 72 so that the printing stylus can act effectively against the paper lying against the platen by way of the ink ribbon 75. For fastening the belt 62 onto the carrier 40, two shackles 74 are formed on the belt which can be firmly clamped by means of screwed-on pins 76.

The ink-ribbon magazine 44 and the print element 42 are arranged on the carrier 40 so as to be replaceable. As FIG. 4 in particular shows, there is a receptacle 78 formed on the carrier 40 for the print element 42 in which the latter can be inserted. Two arms 80 formed laterally on the carrier 40 serve for securing the magazine, wherewith projections 82 formed on the arms elastically snap into recesses 84 formed on the magazine. A head part 86 which has a number of functions is fastened by means of bolts 88 onto the region of the carrier turned toward the platen. On the one hand the belt 62 is fastened onto it by means of pins 76 and the shackles 74. On the other hand, the head part serves for guiding the ink ribbon 75. Ridges 90 are arranged on the head part 86 on both sides of the recording or printing region. The upper edges 92 of the ridges drop off at least partly in the direction of the printing plane. Besides these two ridges there are arranged other ridges 94 which are arranged adjacent to the ridges 90 in a rather broad angle to the ink ribbon, (see also FIG. 2). The upper edges 96 of the ridges 94 are designed dropping off more sharply than those of the ridges 90. When the ink ribbon magazine 44 is placed on the carrier 40, the ink ribbon 75 first lies loosely on the upper edges 92 and 96. When the ink ribbon 75 is conveyed by the movement of the carrier 40, it slides down off of the oblique upper edges 92, 96 and is threaded automatically between the front edges 98 of the ridges 90 and the pins 76. In order to ensure this operation reliably, the pins 76 are made higher than the upper edges 92, so that the ink ribbon 75 cannot slip over the pins 76. The front edges 100 of the outer ridges 94 are set back somewhat from the front edges 98. The guide lugs 102 formed on the ink-ribbon magazine 44 for guiding the ink ribbon in and out are set back in turn with respect to the front edges 100. In this way the ink ribbon runs around the front edges 98, 100 and the guide lugs 102 somewhat in the shape of a polygonal train and remains slightly stretched due to the friction occurring there. This effect is increased still further by having the pins extend slightly into the path of the ink ribbon between the ridges 90 and 94.

Figure 3:
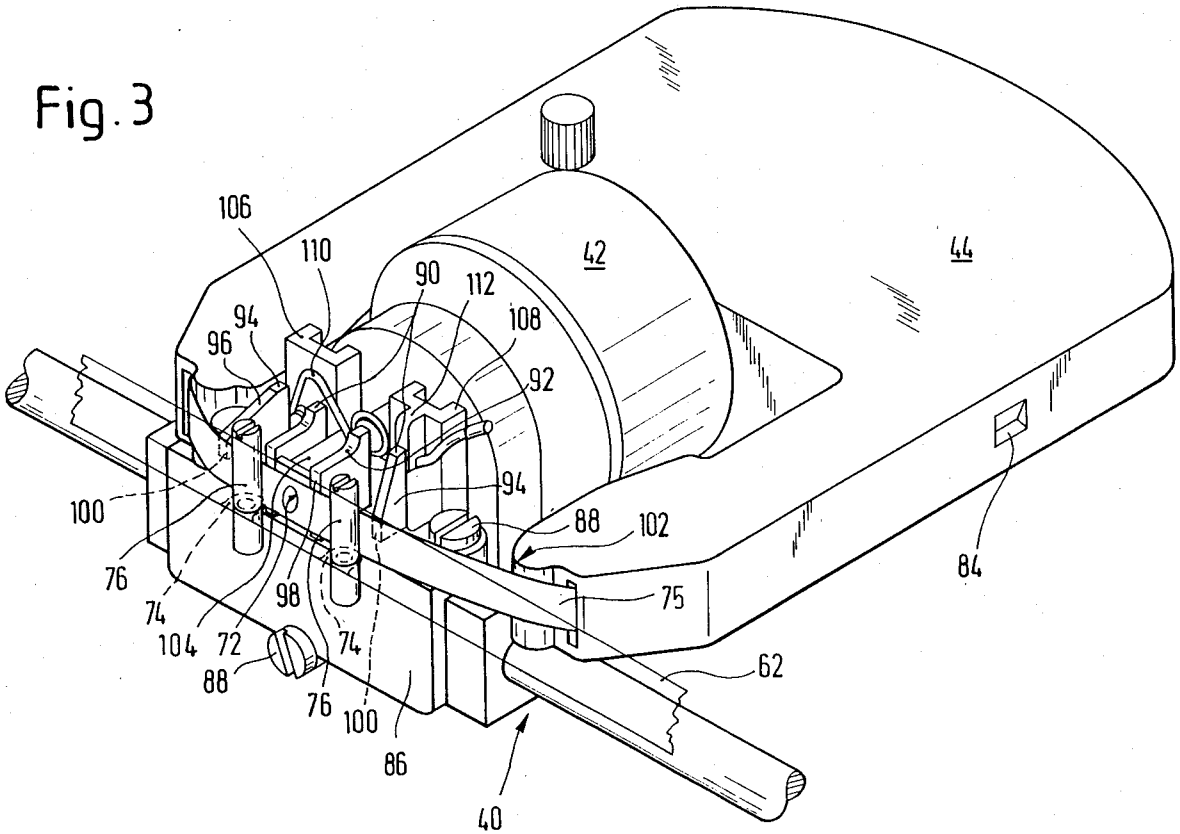
FIG. 3 shows a perspective view of the print head arrangement of a printer according to FIG. 1.

As FIGS. 2 and 3 show, the inner ridges 90 at the same time serve as a lateral support for the needle channel 104 of the print element 42. Two upright supports 106, 108 standing on the print element serve for the emplacement of the print element 42 in a direction perpendicular to the printing plane. A spring buckle 110 arranged pivoting on the upright support 106 can be swiveled over the needle channel 104 and be locked under a lug 112 formed on the upright support 108.

In order to be able to adjust the spacing of the print element from the platen 18 to match exactly the thickness of the paper to be printed, to a number of positions if necessary, the whole carrier 40 is movable in a direction perpendicular to the printing plane. For this the supporting shaft 46 is mounted to be movable parallel to itself, in the housing, here the lower pan 6, as FIG. 4 in particular shows. The supporting shaft 46 is also mounted to be rotatable. In each of its end regions there are eccentric disks 114 joined to it rotationally fixed. The radial cams 116 of the eccentric disks 114 are supported against support surfaces 120 formed on a supporting frame 118. The supporting frame 118 is fastened in movable form on the upper pan 6 for the purpose of an exact adjustment. The supporting shaft 46 is loaded by springs 122 in such a way that the radial cam 166 of the eccentric disk 114 is always pressed against the supporting surfaces 120. By rotating the eccentric disk 114 together with the supporting shaft 46 this is pushed in one direction or the other corresponding to the varying eccentricity of the radial cam 116. As is shown particularly in FIG. 5, the radial cam 116 shows a first region $\alpha$ in which its eccentricity varies only slightly. This region serves for the fine adjustment of the print element 42, for example in the range of millimeters or fractions of a millimeter, and permits fitting various thicknesses of paper. In the region $\beta$ of the radial cam 116 the eccentricity changes are very marked, so that for a small angle of rotation of the eccentric disk 114 the print element is shifted by a large amount. This region serves to raise the print element for inserting new paper. As is seen from FIG. 4, the radial cam 116 of the eccentric disk is respectively provided with slight rest recesses, for example surfaces contiguous like facets. These rest recesses have the result that the adjustment of the print element is done not continuously but in steps corresponding approximately to certain definite paper thicknesses. Besides this, for example, it permits the operating personnel to add up the number of adjusting steps, since the rest recesses can be traced in the adjustment.

The rotation angle of the eccentric disk 114 is absolutely limited in the lifting direction by stops 124 formed on it and in the feed direction by stops 126. These stop surfaces then lie against the support surface 120 of the support frame 118. For adjusting the eccentric disk 114, a feed knob 132 is provided which can be coupled with this disk by way of the gearings 128, 130. The adjusting knob 132 as a whole is mounted to be rotatable and movable on the supporting shaft 46. The angle of rotation of the adjusting knob 132 in the feed direction is limited by a stop pin 134 arranged on the adjusting knob as well as a stop 136 formed on the support frame 118. In a starting position the adjusting knob 132 is arranged in an angular position to the eccentric disk 114 such that the stop 126 of the eccentric disk 114 as well as the stop 134 of the adjusting knob 132 come into position at the same time. With this starting position the next feeding of the print element 42 to the platen 18 is reached. In order to preselect a smaller feed, the adjusting knob 132 is uncoupled from the eccentric disk 114, rotated in the feed direction and again coupled; for one feed the stop pin 134 comes to rest against the stop 136 before the whole radial cam curve 116 has run out. In this way a certain feed can be preselected. The preselection of certain feeds is facilitated by a scale or the like arranged on the adjusting knob 132 as well as by an index marking or the like arranged on the eccentric disk 114.

Figure 4:
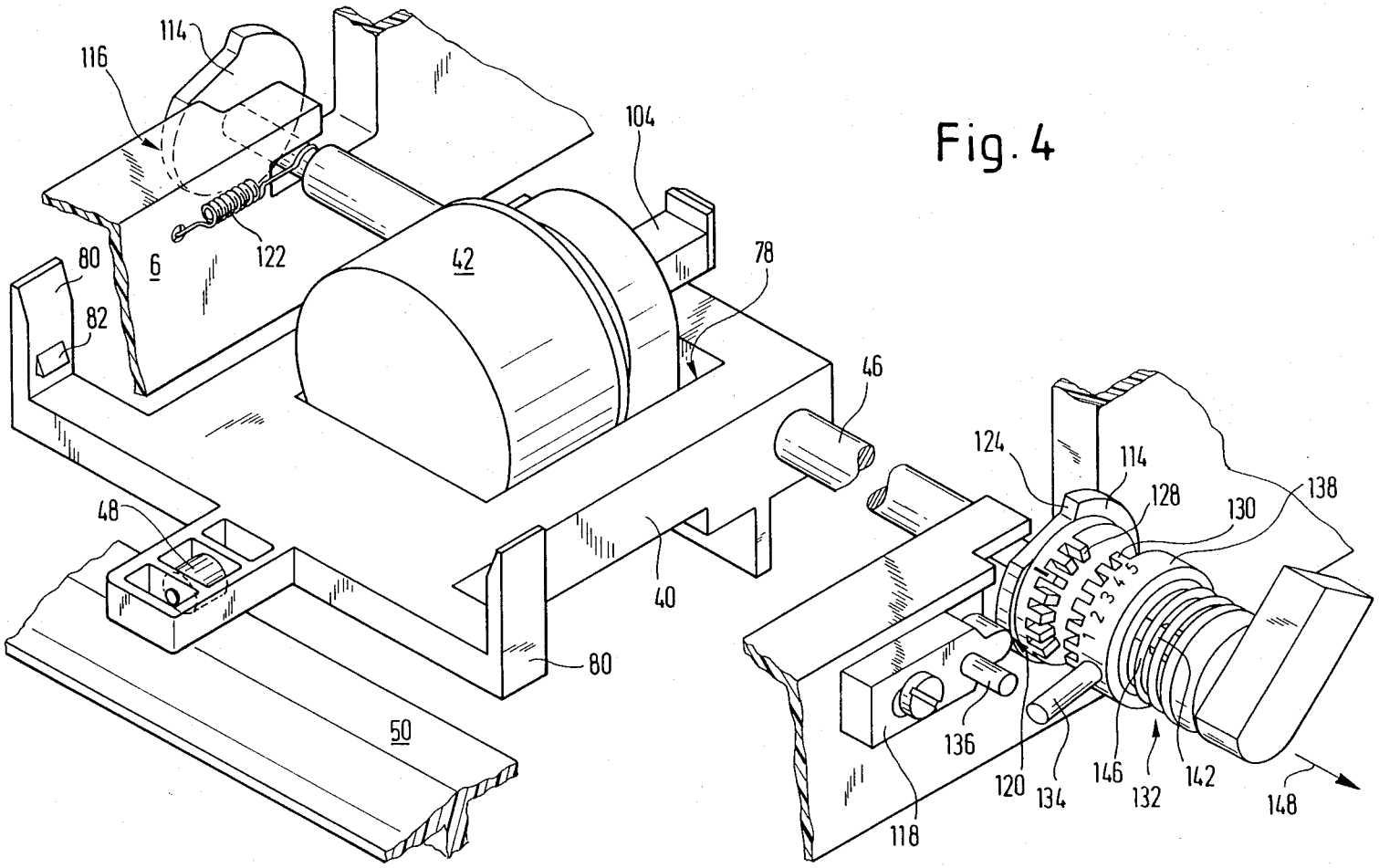
FIG. 4 shows a perspective representation of the print head arrangement as well as a feed unit for this.
Figure 5:
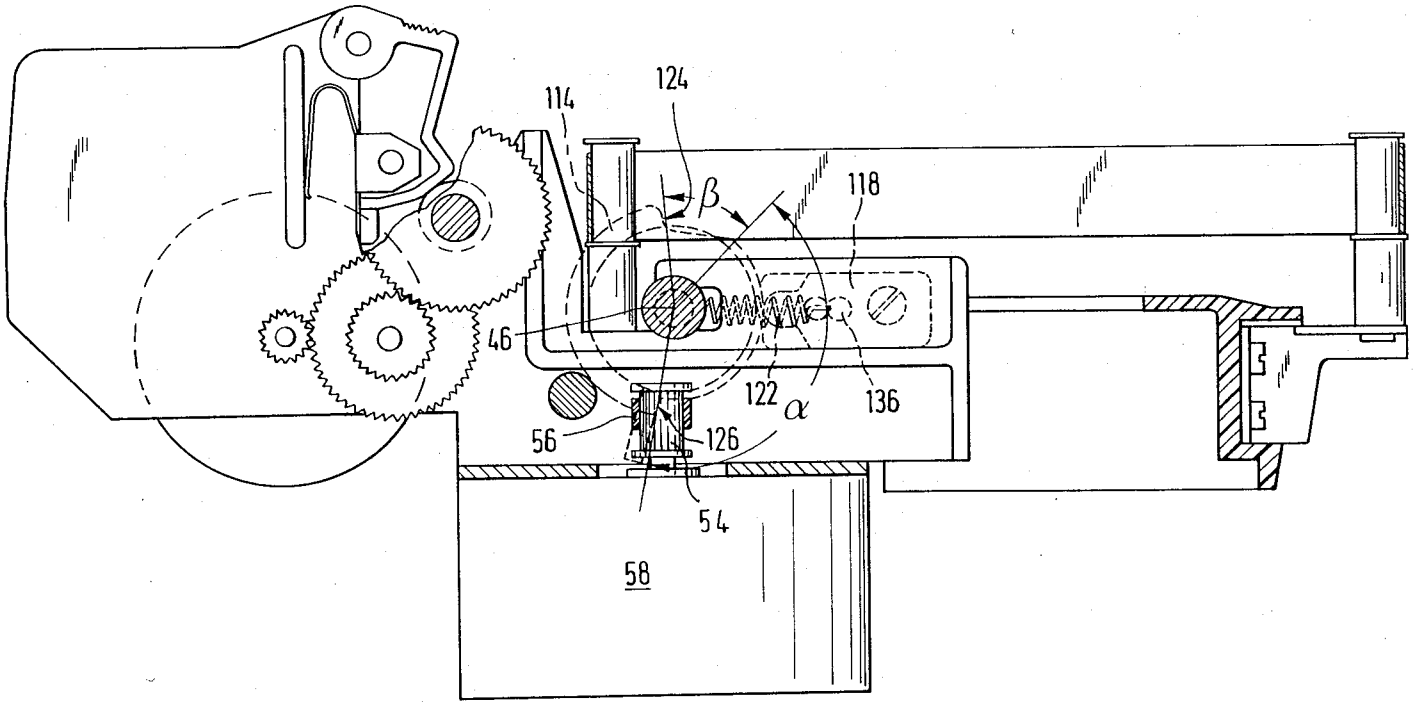
FIG. 5 shows a diagrammatic sectional representation particularly of the feed unit according to FIG. 4.

As FIGS. 2 and 4 show, the adjusting knob 132 consists of a clutch part 138 as well as a handle part 140. The clutch part 138 and handle part 140 can be connected together by fingers 142 formed on the handle part and catching in the clutch part. There is an end disk 144 arranged fixed on the supporting shaft 46. Between the clutch part 138 and the end disk 144 is arranged a pressure spring. By pulling the handle part 140 in the direction of the arrow 148, the clutch part 138 is carried along against the force of the pressure spring 146. When the handle 144 is released, the clutch part 138 is automatically recoupled with the eccentric disk.

Figure 6:
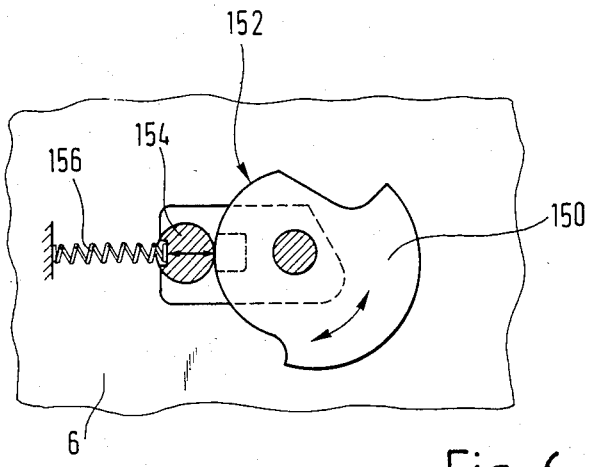
FIG. 6 diagrammatically shows one detail of a feed unit in a modified embodiment.

FIG. 6 diagrammatically shows an arrangement in which an eccentric disk 150 is mounted rotatably in the upper pan 6 and by its radial cam 152 is placed against the movably mounted supporting shaft 154 which is held by a spring 156 so as to lie against the radial cam 152.

Figure 7:
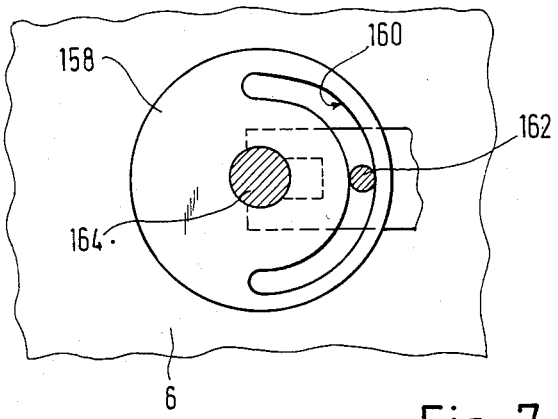
FIG. 7 diagrammatically shows one detail of a feed unit in another embodiment.

In FIG. 7 an apparatus is represented in which the eccentric disk 158 is provided with a cam lever type cam 160 in which a sliding block 162 engages. In the embodiment example represented the eccentric disk 158 is fastened rotationally fixed on the supporting shaft 164, while the sliding block 162 is firmly joined with the housing or the upper pan 6. In this arrangement the supporting shaft 164 is guided under restraint in its feed motion, so that no pressure springs corresponding to the examples described previously are required.

We claim:

1. In a printer apparatus of the type having a roller platen rotatably mounted in a housing, a printer carrier movable in a line direction across the platen, and a printer unit mounted on the carrier, the improvement which comprises:

a single flexible strip of material mounted in an essentially closed loop within said housing and having a portion extending along said platen between the platen and the printer unit for holding paper into contact with the platen;

a plurality of at least three spaced roller means mounted in said housing for collectively supporting said strip in said closed loop configuration and for permitting movement of said strip in said line direction relative to said platen;

means securing said strip to said printer carrier whereby movement of said carrier causes synchronous movement of said strip relative to said platen;

an aperture formed in said strip in the area of said printer unit to permit said printer unit to access paper through said strip; and said strip being constructed with spaced apart terminal ends, the combination further including spring means joining said terminal ends, said spring and said strip together creating a closed loop, said spring serving to maintain tension on said strip.

2. Apparatus as defined in claim 1 further including paper receiving aperture means in said housing rearwardly of said platen;

guide plate means in said housing and extending from a position proximate said paper receiving aperture means to a distal edge between said strip and said platen for non-interferingly guiding paper from said paper aperture to a position between said strip and said platen.

3. Apparatus as defined in claim 1 wherein said strip is made of a transparent material.

* * * * *